US010060715B1

(12) United States Patent
Davis

(10) Patent No.: US 10,060,715 B1
(45) Date of Patent: Aug. 28, 2018

(54) NONLETHAL INCAPACITATING BULLET

(71) Applicant: Desi A Davis, Dallas, TX (US)

(72) Inventor: Desi A Davis, Dallas, TX (US)

( * ) Notice: Subject to any disclaimer, the term of this patent is extended or adjusted under 35 U.S.C. 154(b) by 0 days.

(21) Appl. No.: 15/165,908

(22) Filed: May 26, 2016

Related U.S. Application Data

(60) Provisional application No. 62/167,375, filed on May 28, 2015.

(51) Int. Cl.

| | |
|---|---|
| ***F42B 12/74*** | (2006.01) |
| ***F42B 12/82*** | (2006.01) |
| ***F42B 12/36*** | (2006.01) |
| ***F42B 12/46*** | (2006.01) |

(52) U.S. Cl.
CPC ..... *F42B 12/74* (2013.01); *F42B 12/36* (2013.01); *F42B 12/367* (2013.01); *F42B 12/46* (2013.01); *F42B 12/82* (2013.01)

(58) Field of Classification Search
CPC ..... F42B 12/36; F42B 12/367; F42B 12/46; F42B 12/72; F42B 12/74; F42B 12/745; F42B 12/76; F42B 12/78; F42B 12/80; F42B 12/82
USPC ..... 102/439, 512, 513, 502
See application file for complete search history.

(56) References Cited

U.S. PATENT DOCUMENTS 1,427,263 A * 8/1922 Clapp ..... F42B 7/08 162/143
3,429,263 A * 2/1969 Lont ..... F42B 12/40 102/513
3,502,025 A 3/1970 Payne
3,580,178 A * 5/1971 Kopsch ..... F42B 12/82 102/515
3,782,286 A * 1/1974 Jones ..... F41C 27/06 102/502
5,009,164 A * 4/1991 Grinberg ..... F42B 8/14 102/501
5,035,183 A * 7/1991 Luxton ..... F42B 8/16 102/447
5,295,439 A 3/1994 Carbone
5,490,463 A * 2/1996 Lamberty ..... F42B 5/025 102/430
5,565,649 A * 10/1996 Tougeron ..... F42B 12/36 102/370
5,652,407 A 7/1997 Carbone
5,698,815 A 12/1997 Ragner
5,821,450 A 10/1998 Fedida
6,250,226 B1 6/2001 Leichter et al.
6,543,365 B1 * 4/2003 Vasel ..... F41B 11/57 102/367
7,100,514 B2 9/2006 LeBourgeois
7,143,699 B2 12/2006 Brock
7,234,399 B2 * 6/2007 Rastegar ..... F41J 2/00 102/400

(Continued)

*Primary Examiner* — James S Bergin
(74) *Attorney, Agent, or Firm* — Kenneth L. Tolar

(57) ABSTRACT

A nonlethal bullet includes a casing having an open front end with a frangible rubber bullet head seated therein. The bullet head includes a tip with an opening thereon that is in communication with an interior chemical chamber. A plug adhesively secured within the opening is driven into the chemical chamber upon impact with a target. Accordingly, when the bullet is fired by a weapon and strikes an intruder or assailant, the plug is driven into the chemical chamber, causing the tip to splinter, releasing the incapacitating agent.

10 Claims, 2 Drawing Sheets

(56) References Cited

U.S. PATENT DOCUMENTS

| | | | | |
|---|---|---|---|---|
| 7,526,998 | B2 * | 5/2009 | Vasel | F42B 7/08 102/370 |
| 7,549,376 | B1 * | 6/2009 | Grossman | F42B 10/50 102/400 |
| 7,690,311 | B1 | 4/2010 | Cronemberger | |
| 8,286,557 | B2 * | 10/2012 | Endicott | F42B 12/40 102/444 |
| 8,342,098 | B2 | 1/2013 | Shalev et al. | |
| 8,359,978 | B2 * | 1/2013 | Endicott | F42B 12/40 102/444 |
| 8,671,841 | B2 * | 3/2014 | Raquin | F42B 12/34 102/335 |
| 8,701,325 | B1 * | 4/2014 | Rayner | F41H 13/00 42/1.08 |
| 8,875,634 | B2 * | 11/2014 | Gibson | F42B 10/06 102/502 |
| 8,881,654 | B2 * | 11/2014 | Seecamp | F42B 12/36 102/502 |
| 9,157,715 | B1 * | 10/2015 | Lafortune | F42B 12/40 |
| 2004/0050285 | A1 * | 3/2004 | Zozulya | F42B 12/82 102/517 |
| 2006/0011090 | A1 * | 1/2006 | Vasel | F41B 11/62 102/512 |

* cited by examiner

NONLETHAL INCAPACITATING BULLET

CROSS REFERENCE TO RELATED APPLICATIONS

This application is entitled to the benefit of provisional patent application No. 62/167,375 filed on May 28, 2015, the specification of which is incorporated herein by reference.

BACKGROUND OF THE INVENTION

The present invention relates to a nonlethal firearm bullet that merely incapacitates an intruder or assailant.

DESCRIPTION OF THE PRIOR ART

Many homeowners maintain various weapons to defend themselves against an intruder or an assailant. Because a firearm is designed to kill, many victims refuse to discharge it in a threatening situation to avoid the guilt and mental anguish usually associated with killing or injuring another person. Therefore, a firearm can be a useless form of protection for many people.

Accordingly, there is a need for a firearm bullet that will not fatally wound a target. A review of the prior art reveals a few nonlethal bullets that are designed to temporarily incapacitate an assailant. For example, U.S. Pat. No. 3,502,025 issued to Payne discloses a non-penetrating, drug-injecting bullet including a body formed of an elastomeric material that deforms when impacting a target. Within the bullet is a chamber having an incapacitating agent therein. A hypodermic needle extends from the chamber toward a bullet nose. Upon impact with a target, the bullet collapses, allowing the needle to inject the incapacitating agent.

U.S. Pat. No. 7,143,699 issued to Brock discloses a bullet having a nose cap with a plurality of slits that cause the nose cap to spread upon impact to release a dye or an irritant.

Though several incapacitating bullets exist in the prior art, they have several deficiencies. Though the patent to Brock discloses a bullet that spreads upon impact, it is formed of leaves that are separated only by slits. The leaves terminate at distal contiguous ends that coalesce at the bullet tip. Therefore, because the leaves are only separated by direct impact with a target, a minimal collision may leave the bullet intact, preventing release of the irritant.

Conversely, the present invention includes a plug seated within an aperture on a frangible bullet head that is driven into a chemical chamber upon impact to release an incapacitating agent. The exposed central aperture facilitates splintering of the frangible bullet head to minimize harm to the target, and to assure release of the incapacitating agent. Furthermore, the present invention includes a pad between the bullet head and a propellant to tamper acceleration thereby further minimizing serious injury.

SUMMARY OF THE INVENTION

A nonlethal bullet includes a casing having an open front end with a frangible rubber bullet head seated therein. The bullet head includes a tip with an opening thereon that is in communication with an interior chemical chamber. A plug adhesively secured within the opening is driven into the chemical chamber upon impact with a target. Accordingly, when the bullet is fired by a weapon and strikes an intruder or assailant, the plug is driven into the chemical chamber, causing the tip to splinter, thereby releasing the incapacitating agent.

It is therefore an object of the present invention to provide a nonlethal bullet that incapacitates an impacted target.

It is therefore another object of the present invention to provide a bullet that immediately releases an incapacitating agent upon impact.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
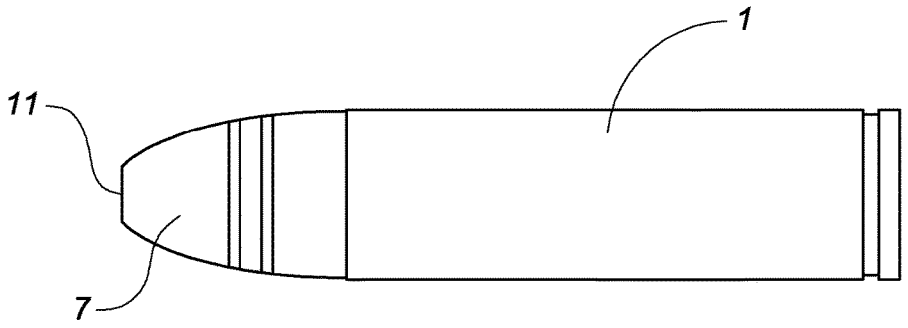
FIG. 1 is a side, plan view of the bullet according to the present invention.
Figure 2:
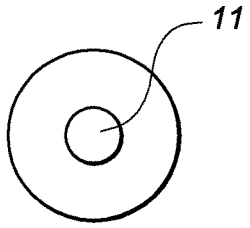
FIG. 2 is an end view of the bullet according to the present invention.
Figure 3:
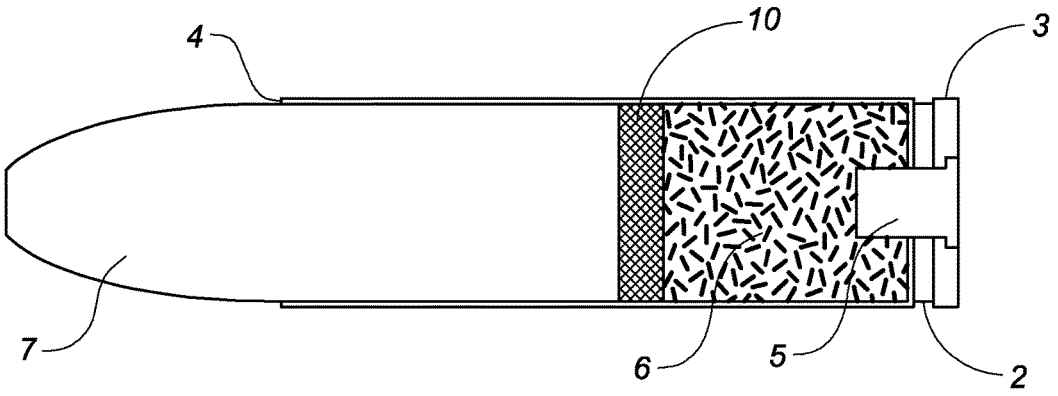
FIG. 3 is a side, sectional view of the bullet.
Figure 4:
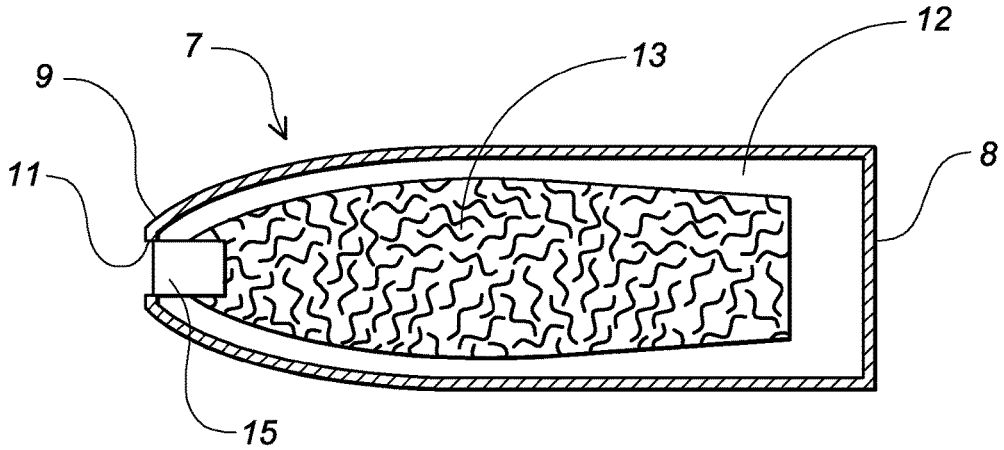
FIG. 4 is a side, sectional view of the bullet head.
Figure 5:
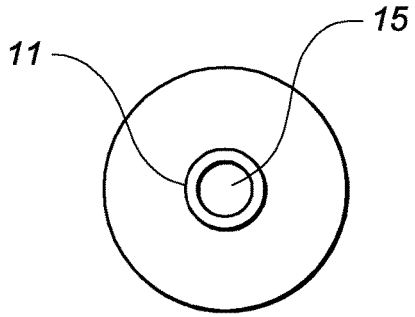
FIG. 5 is an end view of the bullet head.
Figure 6:
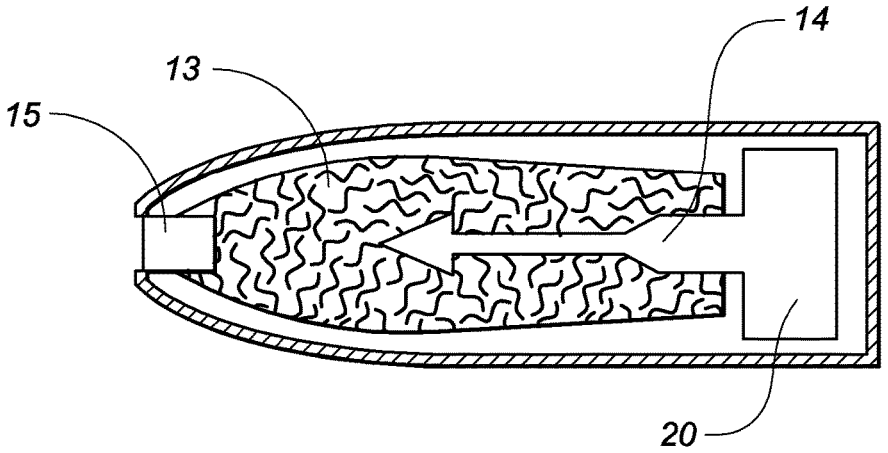
FIG. 6 is a side, sectional view of a slightly different embodiment of the bullet head.

The present invention relates to a bullet including a casing 1 having a closed rear end 2 with a rim thereon 3 and an open front end 4. Attached to the rear end is a primer 5 that is struck by a gun's firing pin to ignite a low-power propellant 6 within an interior compartment. The charge of the propellant is reduced relative to that of conventional bullets to prevent bodily penetration. As such, the propellant is designed to create a muzzle velocity of approximately 200 feet per second or less and a maximum range of approximately 50 feet.

Seated within the open front end is a rubber bullet head 7 having a planar base 8 and a rounded tip 9. The bullet head is coated with a lubricated plastic, such as that commonly marketed and sold under the trademark Teflon™, to prevent the rubber from clinging to a gun barrel or an auto-loading ramp. Positioned between the base and the propellant is a wool felt pad 10 that diminishes acceleration of the bullet head upon firing. The rounded tip includes an opening 11 in communication with an interior chemical chamber 12 containing a volatile incapacitating agent 13. Adhesively bonded within the opening is a plug 15 that is driven into the chemical chamber upon impact. The incapacitating agent can be ammonia, insecticide, capsaicin, chloracetophenone, ortho-chlorobenzylidene or any other substances that temporarily affect vision, consciousness or other senses. As an option, the chemical chamber could also include an electrified barb 14 powered by a super-capacitor 20 or similar means that penetrates the skin to further incapacitate a target in a similar manner as a Taser weapon.

Accordingly, when the bullet is fired by a weapon and strikes an intruder, the plug is driven into the chemical chamber, causing the tip to splinter and separate like a flower, thereby preventing the bullet head from penetrating the target's skin. Furthermore, the incapacitating agent is quickly disseminated to the atmosphere to disable the intruder.

The above-described device is not limited to the exact details of construction and enumeration of parts provided herein. Preferably, the bullet head 7 is constructed with a 45+/−5 Shore A hardness Neoprene rubber, a 45+/−5 Shore A hardness EPDM (ethylene propylene diene monomer) foam or a similar frangible material. The high-density foam will react similarly to the rubber and will cause the incapacitating agent to be dispersed and the bullet to splinter in the desired manner. The EPDM product can be extruded into molds, creating bullet heads that do not require further machining, and which will accept the incapacitating-agent housing as configured. However, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An ammunition cartridge comprising:

a casing having a closed rear end, an open front end and an interior compartment;

a low-power propellant within the interior compartment;

a primer attached to the rear end that is struck by a gun's firing pin to ignite the propellant;

a rubber bullet head seated within the open front end, said rubber bullet head having a planar base and a rounded tip, said rounded tip having an opening in communication with an interior chemical chamber containing a volatile incapacitating agent;

a plug seated within the opening that is driven into the interior chemical chamber upon impact, causing the tip to splinter thereby preventing the bullet head from penetrating the target's skin, while releasing the incapacitating agent to the atmosphere to disable an intruder or assailant.

2. The ammunition cartridge according to claim 1 wherein said rubber bullet head is coated with a lubricated plastic to prevent the rubber bullet head from clinging to a gun barrel or an auto-loading ramp.

3. The ammunition cartridge according to claim 1 further comprising a pad positioned between the base of the rubber bullet head and the propellant that diminishes acceleration of the bullet head upon firing.

4. The ammunition cartridge according to claim 3 wherein the pad is constructed with a wool felt.

5. The ammunition cartridge according to claim 1 further comprising an electrified barb received within the interior chemical chamber, said electrified barb powered by a supercapacitor to further incapacitate a target.

6. The ammunition cartridge according to claim 5 wherein said rubber bullet head is coated with a lubricated plastic to prevent the rubber bullet head from clinging to a gun barrel or an auto-loading ramp.

7. The ammunition cartridge according to claim 5 further comprising a pad positioned between the base of the rubber bullet head and the propellant that diminishes acceleration of the bullet head upon firing.

8. The ammunition cartridge according to claim 7 wherein the pad is constructed with a wool felt.

9. The ammunition cartridge according to claim 5 wherein said bullet head is constructed with a frangible material that splinters when subjected to impact.

10. The ammunition cartridge according to claim 1 wherein said bullet head is constructed with a frangible material that splinters when subjected to impact.

* * * * *